US006182299B1

(12) United States Patent
Chen

(10) Patent No.: US 6,182,299 B1
(45) Date of Patent: Feb. 6, 2001

(54) BASEBALL CHEST PROTECTOR

(75) Inventor: Mike Chien Fang Chen, Taipei Hsien (TW)

(73) Assignee: Racer Sporting Goods Co., Ltd. (TW)

( * ) Notice: Under 35 U.S.C. 154(b), the term of this patent shall be extended for 0 days.

(21) Appl. No.: 09/536,587

(22) Filed: Mar. 28, 2000

(30) Foreign Application Priority Data

May 7, 1999 (TW) ..... 088207288

(51) Int. Cl.[7] ..... A41D 13/00
(52) U.S. Cl. ..... 2/463; 2/463; 2/468; 2/92
(58) Field of Search ..... 2/463, 455, 464–467, 2/2.5, 468, 462, 913

(56) References Cited

U.S. PATENT DOCUMENTS

| | | | | |
|---|---|---|---|---|
| 1,670,239 | * | 5/1928 | Cline | 2/463 |
| 3,076,197 | * | 2/1963 | Glahe | 2/455 |
| 3,125,762 | * | 3/1964 | Glahe | 2/455 |
| 4,272,847 | * | 6/1981 | Buhler | 2/455 |
| 4,847,913 | * | 7/1989 | Chen | 2/92 |
| 5,168,576 | * | 12/1992 | Krent et al. | 2/455 |
| 5,226,192 | * | 7/1993 | Jones et al. | 2/44 |
| 5,325,537 | * | 7/1994 | Marion | 2/455 |
| 6,035,452 | * | 3/2000 | Braxton | 2/455 |

FOREIGN PATENT DOCUMENTS

| | | |
|---|---|---|
| 118731 | 9/1989 | (TW) . |
| 269202 | 1/1996 | (TW) . |

* cited by examiner

*Primary Examiner*—Gloria M. Hale
*Assistant Examiner*—Tejash Patel
(74) *Attorney, Agent, or Firm*—Steven J. Hultquist; William A. Barrett; Marianne Fuierer

(57) ABSTRACT

A baseball chest protector comprises a pad body, a strap assembly, a neck-protecting cushion, a plurality of shock-absorbent pad blocks and a plurality of air vents, in which the pad blocks provide on the chest portion of the pad body are formed with inclined planes in such a shape that the thickness of the upper portion of each pad block is greater than that of the lower portion while the pad blocks provide on the stomach portion of the pad body are formed with curved surfaces; the neck-protecting cushion is a piece of curved plate body which flares out upwardly from the bottom and forms an inverted cone-shaped space. Further, the above-mentioned shock-absorbent pad blocks on the chest portion are formed as a laminate structure of materials with different characteristics.

5 Claims, 3 Drawing Sheets

BASEBALL CHEST PROTECTOR

FIELD OF THE INVENTION

The present invention relates to a baseball chest protector, and more particularly, to a baseball chest protector which effectively protects the chest, stomach and neck portions of a user's body and leads the hit-on ball to a fixed bouncing direction.

BACKGROUND OF THE INVENTION

In baseball sports, in order to avoid injuries caused by a high-speed hit-on ball, catchers and umpires must wear chest protectors to protect the chest and stomach portions of their bodies. Generally, the basic structure of such chest protector is comprised of a pad body made of soft material and a strap assembly for user's wearing.

To meet the various requirements in use, for example, the need for light weight, high strength, wearing convenience, ventilation, comfort, and so on, designs of improved chest protectors based on the above-mentioned basic structure have been provided in this technical field. For example, new polymer materials are introduced to meet the requirements of light weight and high strength; air vents are provided or ventilative materials are used to meet the requirements of ventilation and comfort; strap assemblies comprising elastic belts and adjusting loop devices are adopted to meet the requirement of wearing convenience.

DESCRIPTION OF THE PRIOR ART

ROC (Taiwan) Utility Model Publication No. 118731 disclosed an "Improvement of Baseball Chest Protector" which consists of a main body longitudinally divided into two parts and a strap assembly. The two parts of the main body are secured to each other by a zipper, which makes it possible to release the baseball protector from the front side of a user's body; the main body is constructed by laminating a plurality of foam layers and plastic plates.

ROC (Taiwan) Utility Model Publication No. 269202 disclosed an "Structural Improvement of Catcher's Chest Protector" mainly comprising a flexible pad, a strap and a fastening belt, which is characterized in that a neck-resting cushion, a series of air-venting slots and two columns of bending grooves are provided on the flexible pad so that the flexible pad may possess the effect of ventilation and may be bent conforming with the user's movement to achieve the purpose of wearing comfort.

OBJECTS OF THE INVENTION

The object of the present invention is to provide an improved baseball chest protector in which the specific portions of the chest protector are endowed with appropriate shock-absorbent and strength characteristics depending on the practical use to meet specific requirements.

Another object of the present invention is to provide an improved baseball chest protector in which the requirements of effective protection and wearing convenience may both be achieved simultaneously.

SUMMARY OF THE INVENTION

In order to achieve the above and other objects of the present invention, the baseball chest protector according to the present invention mainly comprises a pad body, a strap assembly, a neck-protecting cushion, a plurality of shock-absorbent pad blocks and a plurality of air vents, in which said neck-protecting cushion surrounds the user's neck; said shock-absorbent pad blocks having different shock-absorption and strength characteristics are respectively disposed in appropriate portions depending on the different needs of each portions, such as chest, shoulder and stomach portions; said air vents are provided between said shock-absorbent pad blocks for the ventilation effectiveness.

BRIEF DESCRIPTION OF THE DRAWINGS

The present invention will be explained in detail by reference to the following description and accompany drawings, in which.

DETAILED DESCRIPTION OF THE PREFERRED EMBODIMENT

Figure 1:
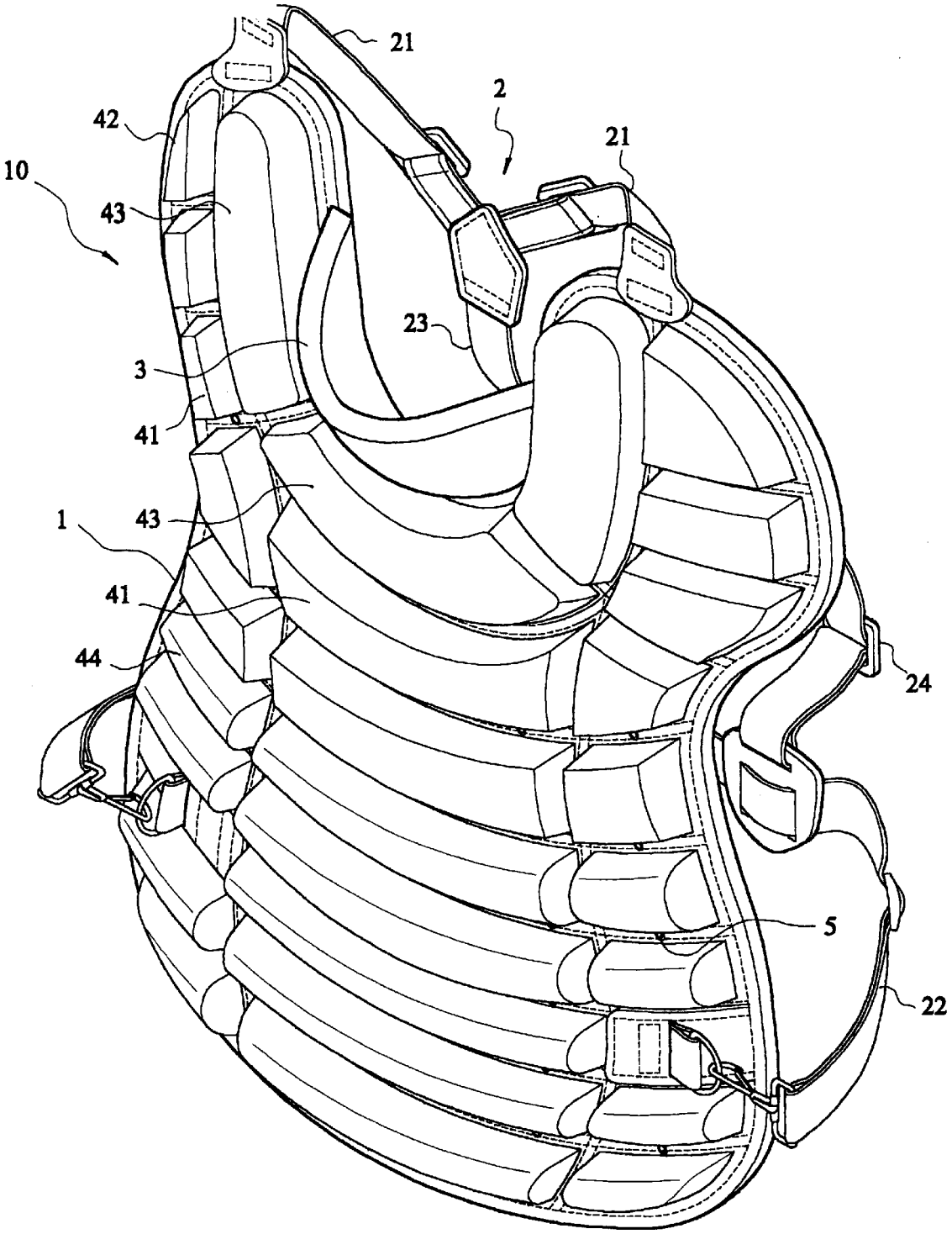
FIG. 1 is a perspective view of one embodiment of the baseball chest protector according to the present invention.
Figure 2:
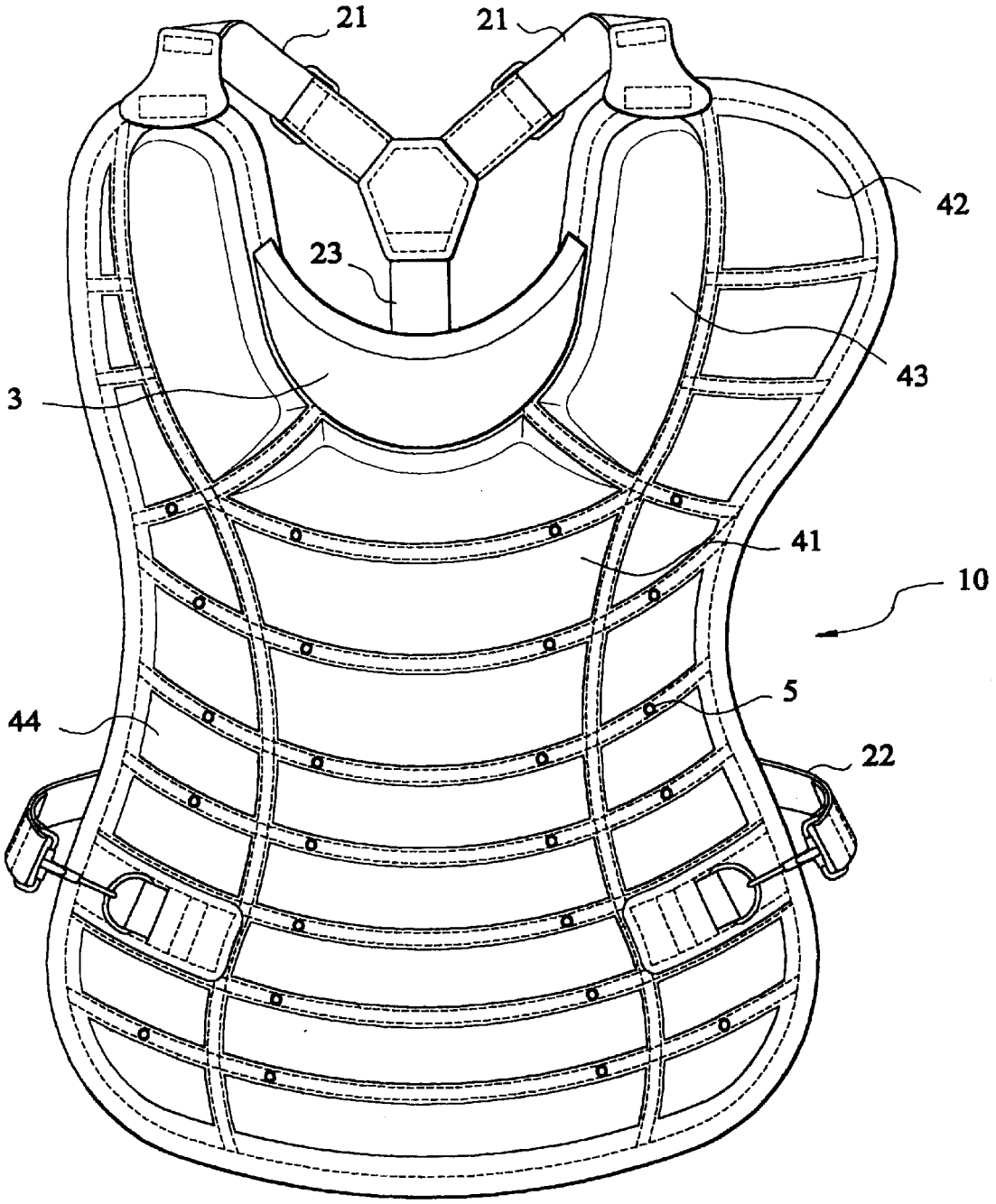
FIG. 2 is a front view of the embodiment in FIG. 1.

As shown in FIG. 1 which illustrates an embodiment of the catcher's chest protector, the baseball chest protector 10 according to the present invention mainly comprises a pad body 1 and a strap assembly 2. The pad body 1 is made of conventional soft pad materials having shock-absorption characteristic, such as polyurethane (PU) material or the like. The strap assembly 2 consists of a plurality of belts and adjusting loops and is secured to the peripheral edge of the pad body 1 for user's wearing. In the example of the catcher's chest protector as shown, the strap assembly 2 consists of two shoulder belts 21, a waist belt 22 and a connection belt 23 interconnecting the shoulder belts 21 and the waist belt 22. The shoulder belts 21 and the waist belt 22 may be secured to the connection portions of the pad body 1 by way of stitching; the shoulder belts 21 and the connection belt 23 may also be secured to each other in the same way and the waist belt 22 is passed through the extremity of the connection belt 23 in a movable manner. Adjusting loops are provided on the shoulder belts 21 and the connection belt 23 for the adjusting the length to be suitable for user's wearing. The main portions of the shoulder belts 21, the waist belt 22 and the connection belt 23 may selectively be made of elastic strap or nylon belt, depending on the practical use.

Figure 3:
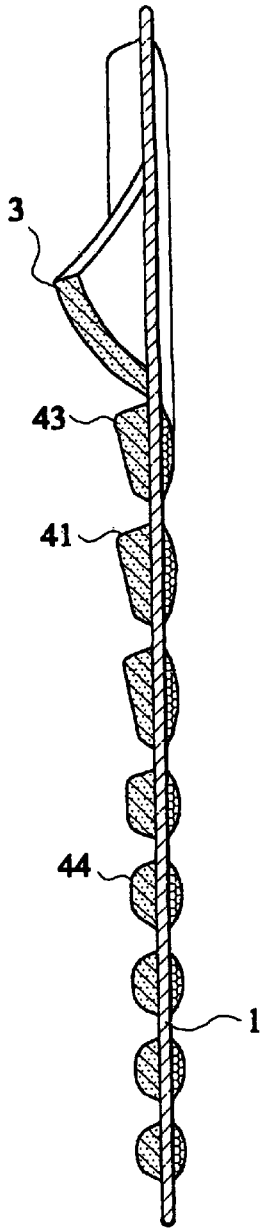
FIG. 3 is a side sectional view of the embodiment in FIG. 1.

Further, as shown in FIGS. 1 and 3, a neck-protecting cushion 3 is provided on the pad body 1 around the portions corresponding to the user's neck. The neck-protecting cushion is a piece of curved plate body made of shock-absorption material such as PU material, which conforms with the U-shaped space on the pad body 1 and flares out upwardly forming an inverted cone-shaped space so as to surround user's neck portion and achieve the neck protecting effectiveness.

A plurality of shock-absorbent pad blocks 4 are disposed on the front side of the pad body 1, in which chest pad blocks 41, shoulder pad blocks 42 and neck-surrounding pad blocks 43 are formed with inclined planes in such a shape that the thickness of the upper portion of each pad block is greater than that of the lower portion, thereby the hit-on ball coming from the front side, after striking such portions, can be guided by the inclined plane to bounce downwardly and naturally drops on the ground, so that it is convenient for a baseball player, especially the catcher, to pick up the ball and the time waste caused by irregular bouncing of the ball may be avoided. The stomach pad blocks 44 are formed with curved surfaces. In addition, a plurality of air vents 5 are arranged between said shock-absorbent pad blocks 4 to enhance the ventilation function of the baseball chest protector and improve the wearing comfort.

Figure 4:
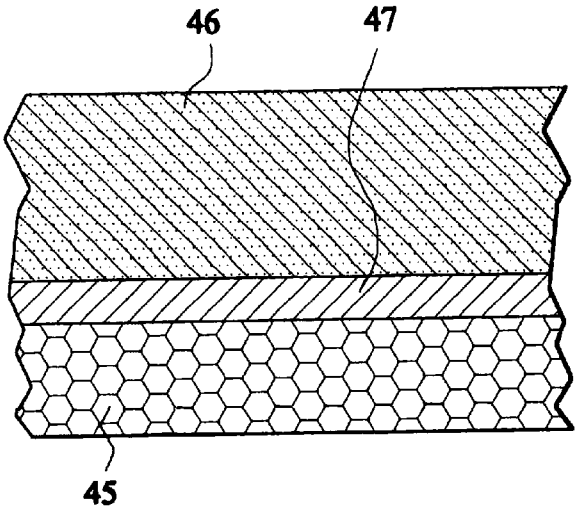
FIG. 4 is a sectional schematic view of the shock-absorbent pad blocks respectively disposed on the chest, shoulder and neck surrounding portions of the baseball chest protector according to the present invention.

As shown in FIG. 4, to meet the requirement of reinforcing the portions protecting the user's chest, shoulders and neck surrounding portions where there exist more bones in a human upper body, the chest pad blocks 41, shoulder pad blocks 42 and neck-surrounding pad blocks 43 are formed into a laminate structure consisting of inner and outer soft materials 45, 46 and a flexible sheet 47 sandwiched thereberween, in which, the inner soft material 45 of said chest pad blocks 41, shoulder pad blocks 42 and neck-surrounding pad blocks 43 is made of PU foam not formed under heat and pressure, while the outer soft material 46 is made of PU foam formed under heat and pressure. In addition, the flexible sheet of the medially sandwiched layer may selectively be made of polyethylene (PE) material. The above-described laminate structure may simultaneously incorporate both the shock-absorption and durability of the pad body 1, and may provide a better protecting effectiveness than that of the conventional protector utilizing materials of single characteristic.

The stomach pad blocks 44 are made of single soft material, such as PU foam not formed under heat and pressure, the flexibility of which allows the stomach portion of the chest protector to be bent freely without restricting the mobility of the user's body While the foregoing description is merely set forth as an illustration of an embodiment according to the present invention, it is to be understood that any modifications and changes may be accomplished based on the spirit and the appended claims without departing from the scope of the invention as claimed. For example, different numbers and arrangements of the pad blocks and various of conventional sock-absorbent materials may be adopted depending on the practical use.

DESCRIPTION OF REFERENCE NUMERALS

10 . . . chest protector
1 . . . pad body
2 . . . strap assembly
3 . . . neck-protecting cushion
4 . . . shock-absorbent pad blocks
5 . . . air vents
21 . . . shoulder belts
22 . . . waist belt
23 . . . connection belt
24 . . . adjusting loop
41 . . . chest pad blocks
42 . . . shoulder pad blocks
43 . . . neck-surrounding pad blocks
44 . . . stomach pad blocks
45 . . . soft material
46 . . . soft material
47 . . . flexible sheet

What is claimed is:

1. A baseball chest protector, comprising:

a pad body comprising a chest portion, an upper portion, a peripheral edge, a shoulder portion, a neck-surround portion, and a stomach portion;

a strap assembly consisting of a plurality of belts and adjusting loops and secured to the peripheral edge of said pad body for user's wearing;

a neck-protecting cushion provided on said pad body at the upper portion thereof corresponding to the user's neck.

a plurality of shock-absorbent pad blocks disposed on a front surface of said pad body; and a plurality of air vents formed on said pad body between said shock-absorbent pad blocks, wherein said pad blocks disposed on the chest portion, shoulder portion and neck-surrounding portion of said pad body are formed with inclined planes having a shape wherein a thickness of an upper portion of each said pad block is greater than that of a lower portion of said pad block, and said pad blocks disposed on the stomach portion of said pad body being formed with curved surfaces; and the neck-protecting cushion comprising a piece of curved plate body flaring out upwardly from the bottom to form an inverted cone-shaped space.

2. The baseball chest protector according to claim 1, wherein said shock-absorbent pad blocks disposed on the chest portion, shoulder portion and neck-surrounding portion of said pad body are made of a laminate structure consisting of inner and outer soft materials and a flexible sheet medially sandwiched therebetween.

3. The baseball chest protector according to claim 2, wherein the inner soft material part of said shock-absorbent pad blocks disposed on the chest portion, shoulder portion and neck-surrounding portion of said pad body is made of polyurethane foam not formed under heat and pressure, while the outer soft material part thereof is made of polyurethane foam formed under heat and pressure.

4. The baseball chest protector according to claim 2, the flexible sheet of the medially sandwiched layer is made of polyethylene material.

5. The baseball chest protector according to claim 1, wherein said shock-absorbent pad blocks disposed on the stomach portion of said pad body are made of single soft material.

* * * * *